US006478301B1

(12) United States Patent
Witmeyer

(10) Patent No.: US 6,478,301 B1
(45) Date of Patent: Nov. 12, 2002

(54) SPINNING AND TRANSLATING TARGET FOR FIREARMS

(76) Inventor: Aaron D. Witmeyer, 11320 NW. Morrow Ave., Prineville, OR (US) 97754

( * ) Notice: Subject to any disclaimer, the term of this patent is extended or adjusted under 35 U.S.C. 154(b) by 0 days.

(21) Appl. No.: 10/016,305

(22) Filed: Nov. 1, 2001

(51) Int. Cl.[7] ..... F41J 5/14
(52) U.S. Cl. ..... 273/391; 273/390; 273/378
(58) Field of Search ..... 273/359, 366–370, 273/378, 383, 386–388, 390–392

(56) References Cited

U.S. PATENT DOCUMENTS

| | | | | |
|---|---|---|---|---|
| 518,931 A | | 4/1894 | Allen | |
| 2,085,933 A | | 7/1937 | Vaughan | |
| 2,140,411 A | | 12/1938 | Wood | |
| 2,494,210 A | | 1/1950 | Smith | |
| 2,905,469 A | | 9/1959 | Taylor | |
| 3,103,362 A | * | 9/1963 | Elofson | 273/359 |
| 3,690,664 A | | 9/1972 | Hauke | |
| 3,845,957 A | * | 11/1974 | Lohr et al. | 124/44.6 |
| 3,861,684 A | | 1/1975 | Gastin et al. | |
| 3,992,007 A | | 11/1976 | Seeman | |
| 4,523,762 A | * | 6/1985 | Garner, Sr. | 473/473 |
| 4,588,194 A | | 5/1986 | Steidle et al. | |
| 4,961,587 A | * | 10/1990 | Galvin | 273/375 |
| 5,176,386 A | | 1/1993 | Simmons | |
| 5,431,409 A | | 7/1995 | Webster | |
| 5,467,979 A | | 11/1995 | Zarate | |
| 6,155,571 A | | 12/2000 | Reinertsen | |

FOREIGN PATENT DOCUMENTS

| | | | | |
|---|---|---|---|---|
| DE | 463405 | * | 7/1928 | 273/368 |
| GB | 2210 | * | 2/1905 | 273/359 |

* cited by examiner

*Primary Examiner*—Mark S. Graham
(74) *Attorney, Agent, or Firm*—David S. Alavi

(57) ABSTRACT

A shooting target includes: a pair of support members; a horizontal threaded shaft supported by the support members; and a spinning target positioned on, supported by, and rotatably engaged with the threaded shaft. The spinning target includes a threaded sleeve that translates along the threaded shaft as the sleeve rotates; a pair of opposing arms secured to the sleeve and extending in opposing directions; a pair of flattened target plates secured to the arms; and a pair of weights each secured to and slidable along the respective arm. The sliding weights insure that the spinning target comes to rest vertically. The threaded sleeve may be made sufficiently over-sized so as to enable disengaging of the sleeve and sliding of the sleeve along the threaded shaft. A deflector plate may be provided in front of the threaded shaft to protect it from projectile impacts.

18 Claims, 9 Drawing Sheets

100

100

SPINNING AND TRANSLATING TARGET FOR FIREARMS

FIELD OF THE INVENTION

The field of the present invention relates to targets for firearms. In particular, target is described herein that spins and translates when hit.

BACKGROUND

Shooting targets and competitive target shooting games come in wide ranges of shapes, sized, and varieties. Particularly challenging are those that require hitting a moving target, those that have a marksman working against the clock, and/or those which pit competitors against one another in a test of skill. Targets may also find utility in testing and/or evaluating firearms and or ammunition. Particularly useful are targets that may be set up in a variety of suitable shooting locations, and that are portable.

It is therefore desirable to provide a shooting target that includes a moving target, that enables competition between marksmen, that enables challenging target shooting practice, that enables testing and/or evaluating firearms and/or ammunition, and/or that may be moved among multiple suitable target shooting locations.

SUMMARY

Certain aspects of the present invention may advance the state-of-the-art of targets for firearms, and in addition may meet one or more of the following objects:

To provide a shooting target that spins when hit;

To provide a shooting target that spins and translates when hit;

To provide a shooting target that translates in differing directions when hit in differing locations;

To provide a shooting target that may be used for individual firearms practice;

To provide a shooting target that may be used for firearms competition;

To provide a shooting target that may be use for testing and/or evaluating firearms and/or ammunition;

To provide a shooting target having a threaded spinning target rotatably mounted on a threaded shaft;

To provide a shooting target wherein the threaded spinning target may be disengaged from the threaded shaft and slid along the threaded shaft;

To provide a shooting target wherein the spinning target comes to rest in a substantially vertical orientation;

To provide a shooting target having a pair of sliding weights for orienting the spinning target substantially vertically when it stops spinning;

To provide a shooting target with a deflector plate for protecting the threaded shaft from projectile impacts;

To provide a shooting target with a scale for measuring the amount of movement of the target;

To provide a shooting target that may be repeatedly disassembled and reassembled;

To provide a shooting target with supports that may be driven into the ground; and To provide a shooting target with a base plate.

A shooting target according to the present invention includes: a pair of support members; a threaded shaft supported by the support members in a substantially horizontal position and substantially non-rotatably secured to at least one of the support members; and a spinning target positioned on, supported by, and rotatably engaged with the threaded shaft. The spinning target includes a threaded sleeve on the threaded shaft and engaged therewith so that the threaded sleeve translates along the length of the threaded shaft as the threaded sleeve rotates; a pair of opposing arms secured to the sleeve at their respective proximal ends and extending away from the sleeve; a pair of flattened target plates secured to the respective distal ends of the arms; and a pair of weights each secured to and slidable along the respective arm. The sliding weights insure that the spinning target comes to rest in a substantially vertical orientation. The threaded sleeve may be made sufficiently over-sized so as to enable disengaging of the sleeve and sliding of the sleeve along the threaded shaft. A deflector plate may be provided in front of the threaded shaft to protect it from projectile impacts.

Additional objects and advantages of the present invention may become apparent upon referring to the preferred and alternative embodiments of the present invention as illustrated in the drawings and described in the following written description and/or claims.

DETAILED DESCRIPTION OF PREFERRED AND ALTERNATIVE EMBODIMENTS

Figure 1:
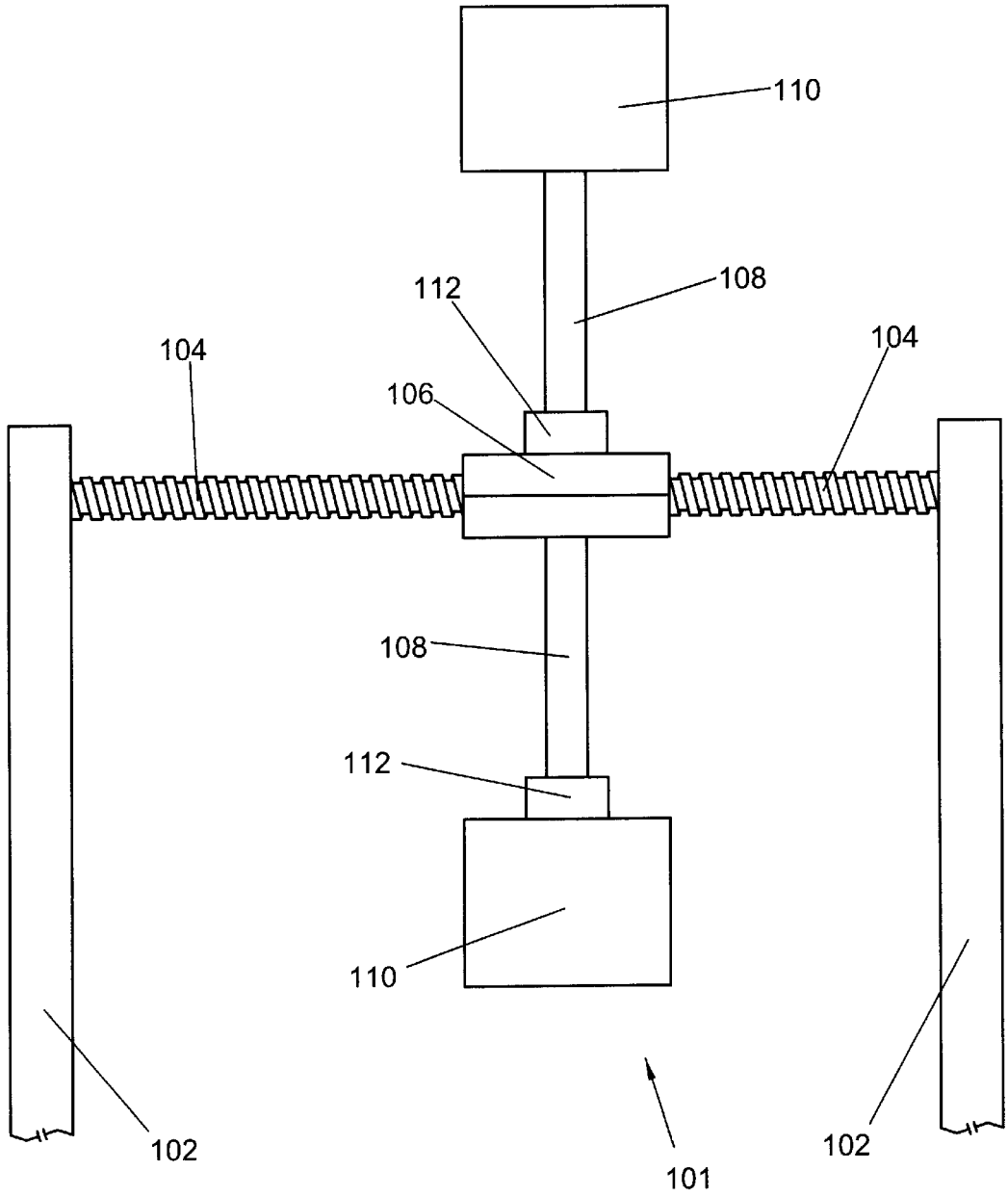
FIG. 1 is a front view of a firearms target according to the present invention.
Figure 2:
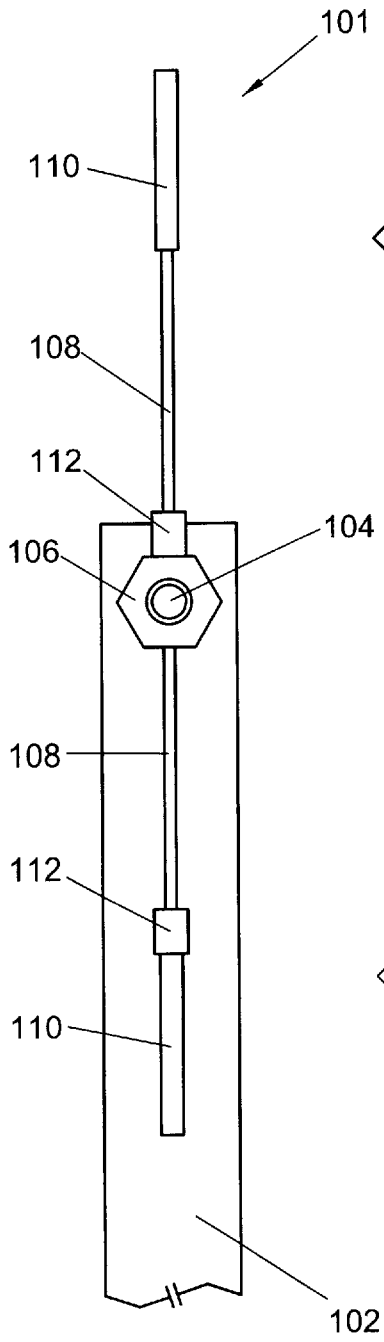
FIG. 2 is a side view of a firearms target according to the present invention.
Figure 3:
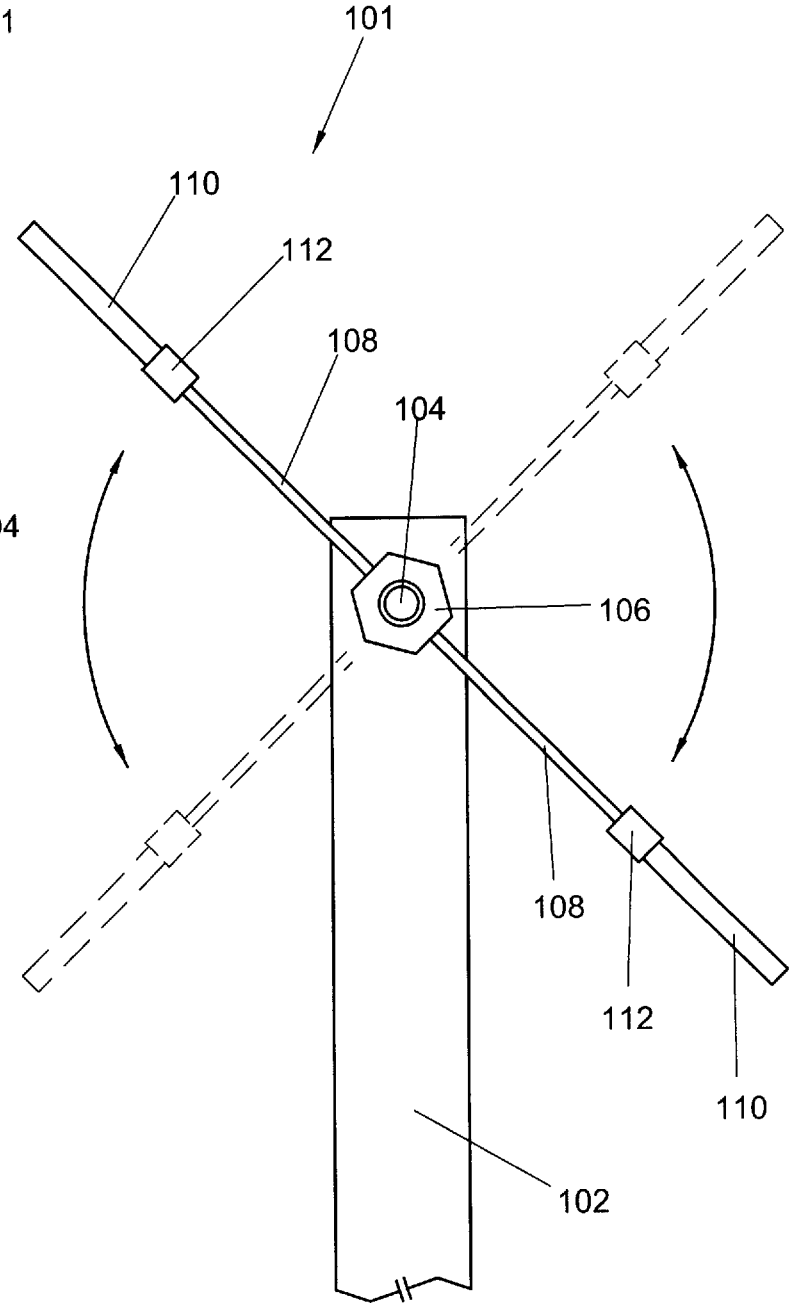
FIG. 3 is a side view of a firearms target according to the present invention.

FIGS. 1 through 3 illustrate a firearms target 100 according to the present invention. A pair of support members 102 support a substantially horizontal threaded shaft 104, which is substantially non-rotatably engaged with at least one of support members 102. A spinning target 101 includes a threaded sleeve 106, a pair of arms 108, a pair of target plates 110, and a pair of weights 112. Threaded sleeve 106 is positioned on shaft 104 and threadedly engaged therewith. The threaded bore through sleeve 106 may preferably be somewhat oversized, so that the threads may be disengaged from shaft 104 and sleeve 106 may slide along the shaft; during normal operation gravity maintains the threaded engagement of sleeve 106 and shaft 104. Alternatively, the threads of sleeve 106 may correspond in size to the mating threads of shaft 104 so that sleeve 106 cannot slide along shaft 104.

Two arms 108 are secured to sleeve 106 and extend away from sleeve 106 in opposing directions. The arms may have any suitable cross-sectional shape, including but not limited to circular, square, rectangular, hexagonal, and so forth. At the end of each arm 108 is a corresponding flattened target plate 110. The target plates may preferably have similar areas and shapes, or may alternatively differ from each other in area and shape. Each arm 108 is provided with a corresponding sliding weight 112 that may slide along arm 108 between sleeve 106 and corresponding target plate 110. The sliding weight 112 may be limited in sliding along corresponding arm 108 by the sleeve 106 and target plate 110, or by one or more stops provided on arm 108 for that purpose (not shown). The lengths of arms 108 (which may be the same as each other or may differ), the weights of target plates 110, the weights of sliding weights 112, and positions of any stops (if present) may be varied to produce a variety of spinning dynamics for spinning target 101. A symmetric arrangement may be preferred, with both arms 108 being of substantially the same length, both target plates 110 having substantially the same area and weight, and both sliding weights 112 having substantially the same weight and able to slide from the sleeve 106 to the corresponding target plate 110. Alternative configurations having differing spinning characteristics may be implemented while remaining within the scope of inventive concepts disclosed and/or claimed herein. While spinning (FIG. 3), sliding weights 112 both slide outward along arms 108 and against target plate 110 (or against a stop that may be present). Engagement of threaded shaft 104 and threaded sleeve 106 produces lateral translation of spinning target 101 as it spins. As the spinning target 101 slows and stops (FIGS. 1 and 2), one of the weights 112 slides down the corresponding arm 108 toward sleeve 106, thereby causing spinning target 101 to come to rest in a substantially vertical orientation, with one target plate 110 above the sleeve 106 and the other target plate 110 below sleeve 106. Spinning target 101 may preferably be arranged so that each target plate 110 has a substantially equal probability of being the upper target plate as the spinning target comes to rest (generally the case for substantially symmetric arrangements for pinning target 101). Alternatively, the spinning target may be arranged so that one target plate or the other usually or always ends up on top as the spinning target comes to rest.

Right-handed threads are shown in the Figures and described in the following written description. However, left-handed threads may be equivalently employed (reversing the directions of movement described hereinbelow). When a bullet or other projectile from a firearm strikes the top target plate 110, engagement of threaded shaft 104 and threaded sleeve 106 causes spinning target 101 to translate to the left as it spins. Similarly, when a bullet or other projectile strikes the bottom target plate 110, spinning target 101 translates to the right as it spins. This may provide the basis for competitive target shooting games. For example, two competing target shooters could simultaneously fire at shooting target 100, with a first shooter aiming at the top target plate and the second aiming at the bottom target plate. The winner could be determined when the spinning target 101 reaches one of the support members or the other, or perhaps markings on threaded shaft 104. Shooting target 100 may also be used by one shooter at a time for time-based competition (shortest time to translate spinning target 101 from one end of the threaded shaft to the other, for example), or for individual practice.

Figure 4:
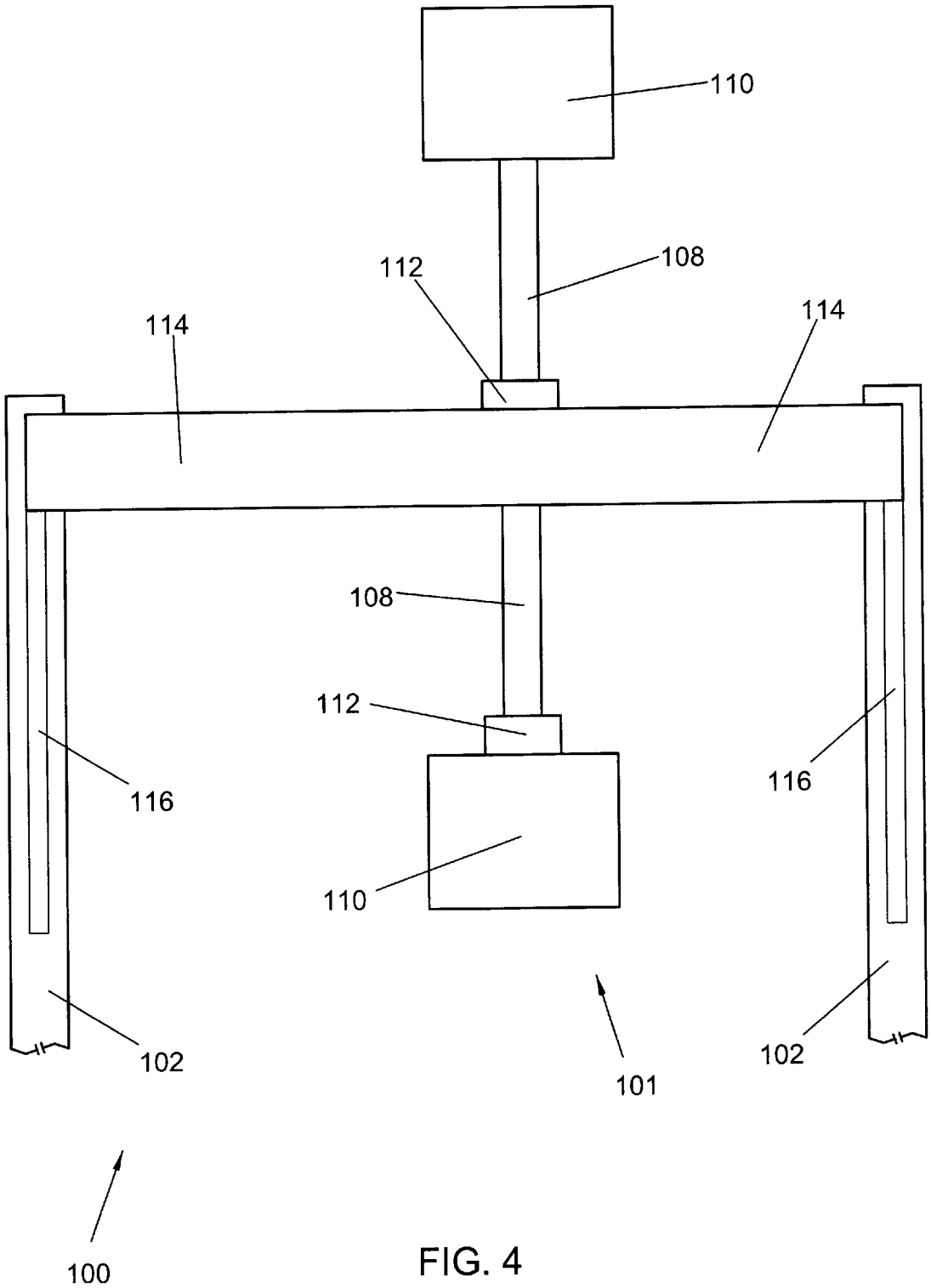
FIG. 4 is a front view of a firearms target according to the present invention.
Figure 5:
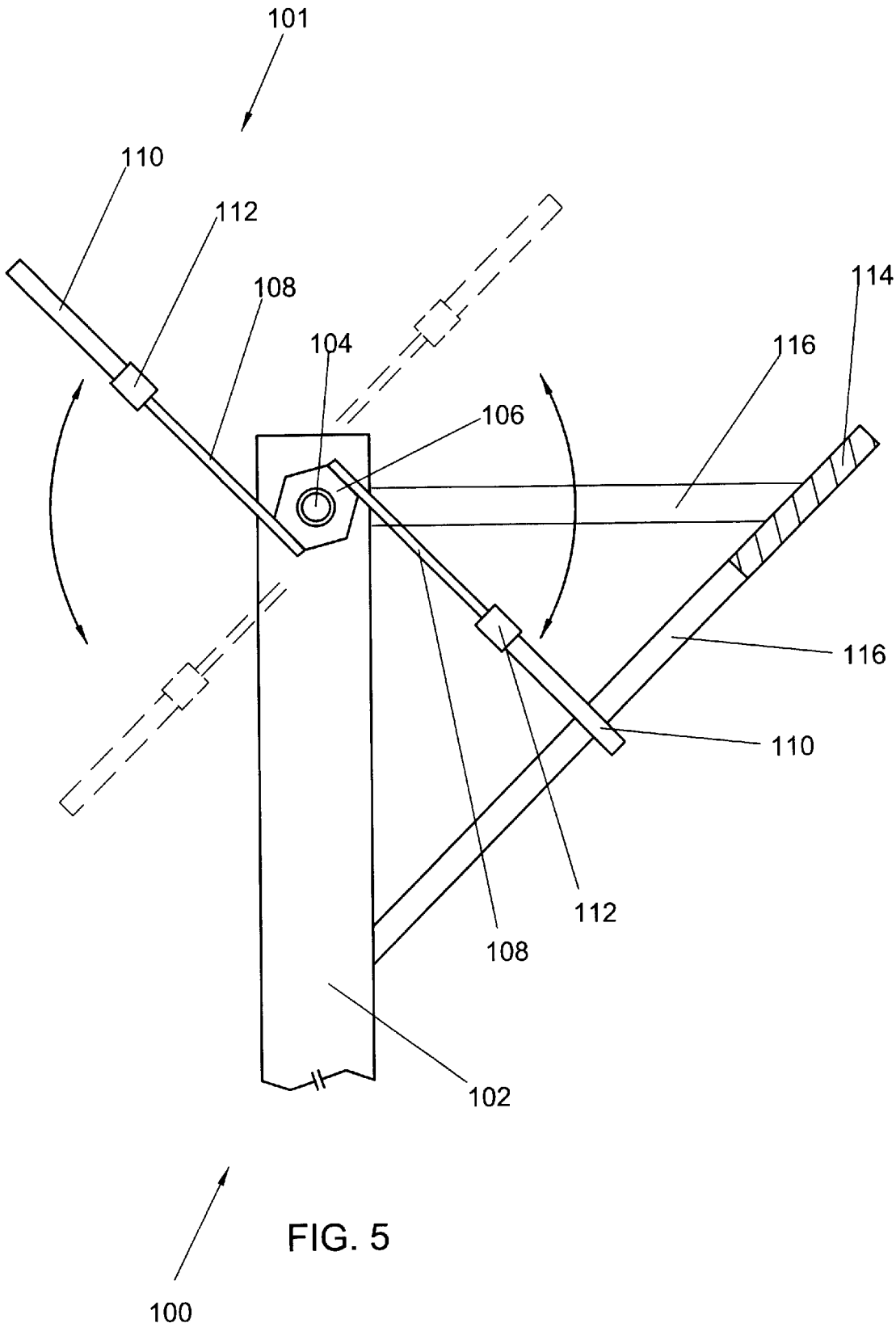
FIG. 5 is a side view of a firearms target according to the present invention.
Figure 6:
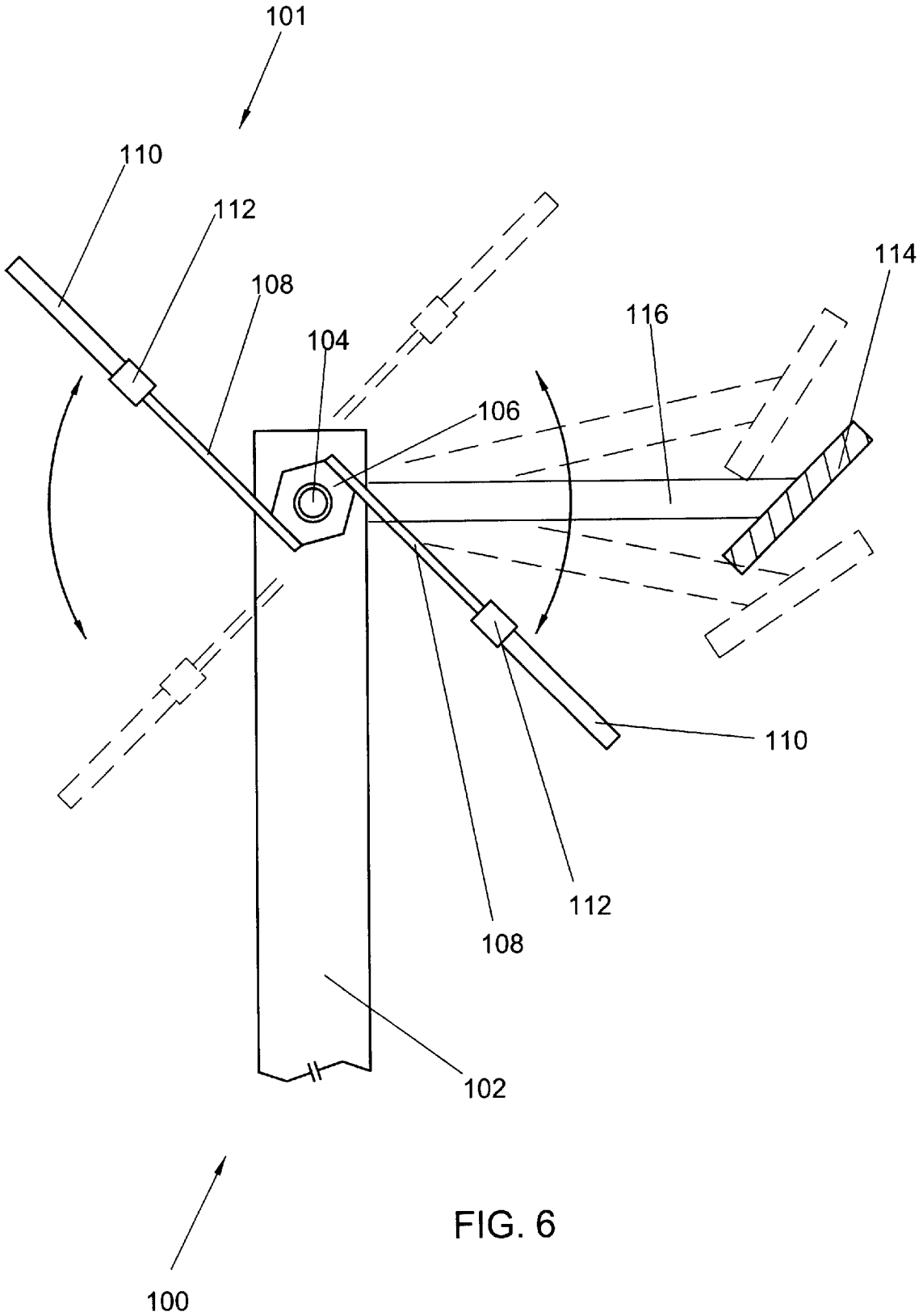
FIG. 6 is a side view of a firearms target according to the present invention.
Figure 7:
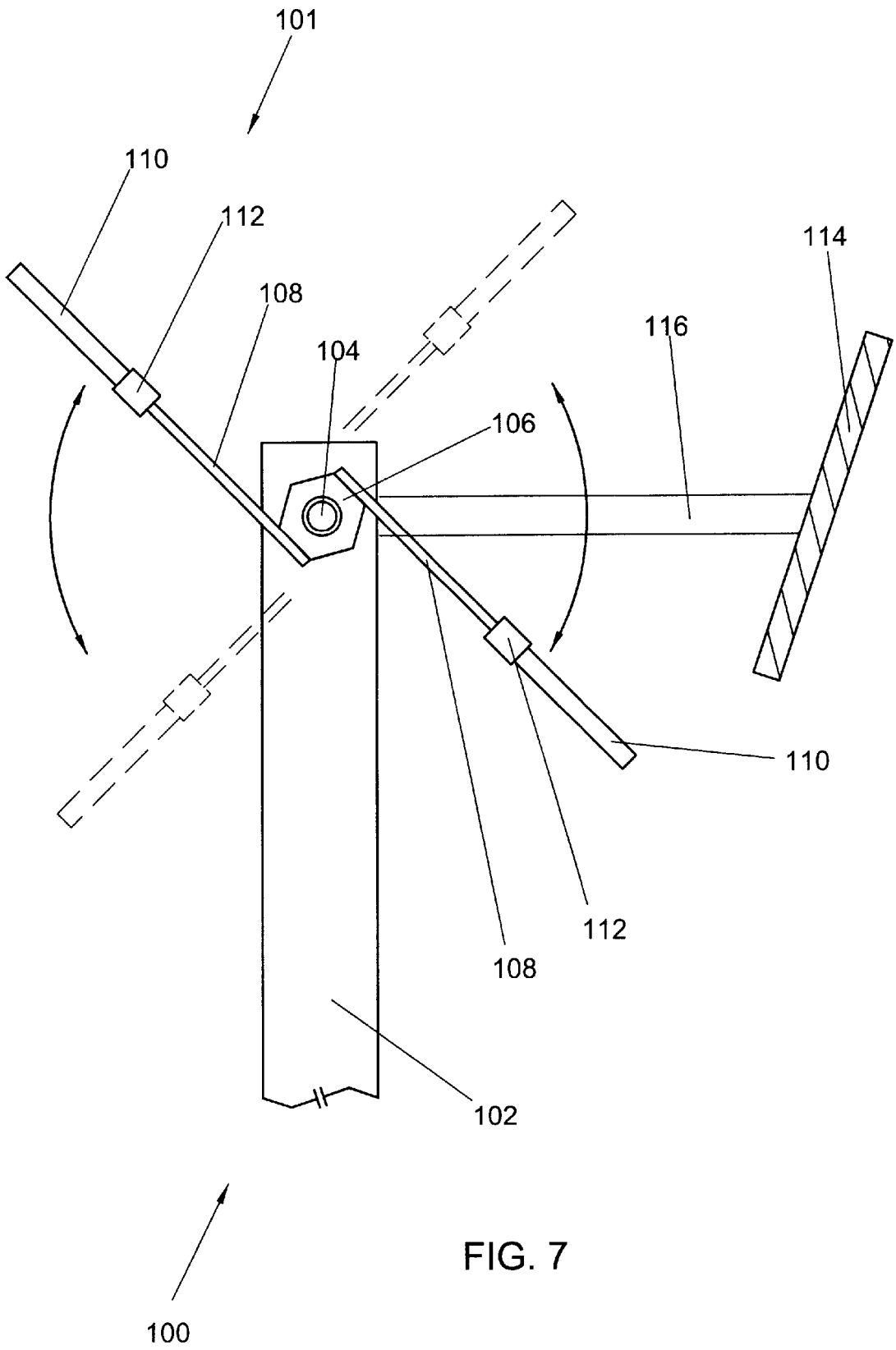
FIG. 7 is a side view of a firearms target according to the present invention.

Target 100 may be further provided with a shield 114 for protecting shaft 104 and sleeve 106 from projectile impacts and/or damage resulting therefrom (FIGS. 4 and 5, which also illustrate an alternative arrangement of sleeve 106 and arms 108). Shield support members 116 serve to hold shield 114 in position in front of shaft 104 and sleeve 106. Shield 114 may have a fixed position, or may have a position adjustable so as to protect shaft 104 and sleeve 106 when shooting target 100 is shot at along varying lines-of-sight (FIG. 6). Shield 104 may preferably be forwardly inclined so as to deflect projectiles downward into the ground (as shown in the Figures), or alternatively may be substantially vertical or backwardly inclined (not shown). Shield 114 may preferably comprises a substantially flat plate (as shown in the Figures) or may have another suitable shape (convex, beveled, or rounded, for example; not shown). Shield 114 and shield support members 116 may be adapted so as to enable variable positioning of shield 114 in front of shaft 104 (FIG. 6). This feature may be useful for adapting the target for use along differing lines-of-sight. An upper shield position may be suitable for firing from a standing position or from a tree, hilltop, or platform, while a lower position may be suitable for firing from a prone position on the ground or from within a trench or blind. Alternatively, shield 114 may be made sufficiently large so as to substantially block shaft 104 along a majority of lines-of-sight suitable for firing on the target (FIG. 7).

Figure 8:
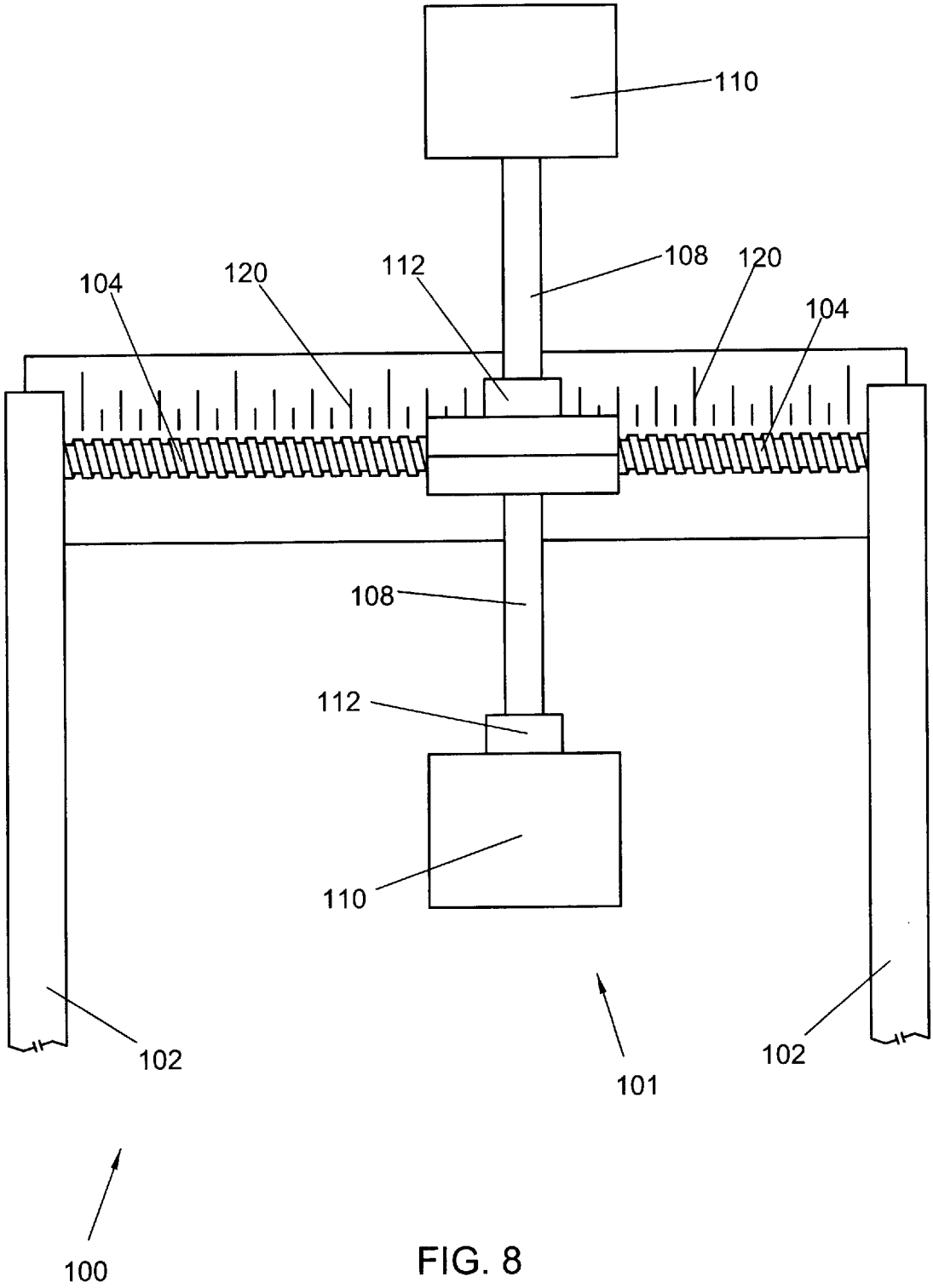
FIG. 8 is a rear view of a firearms target according to the present invention.
Figure 9:
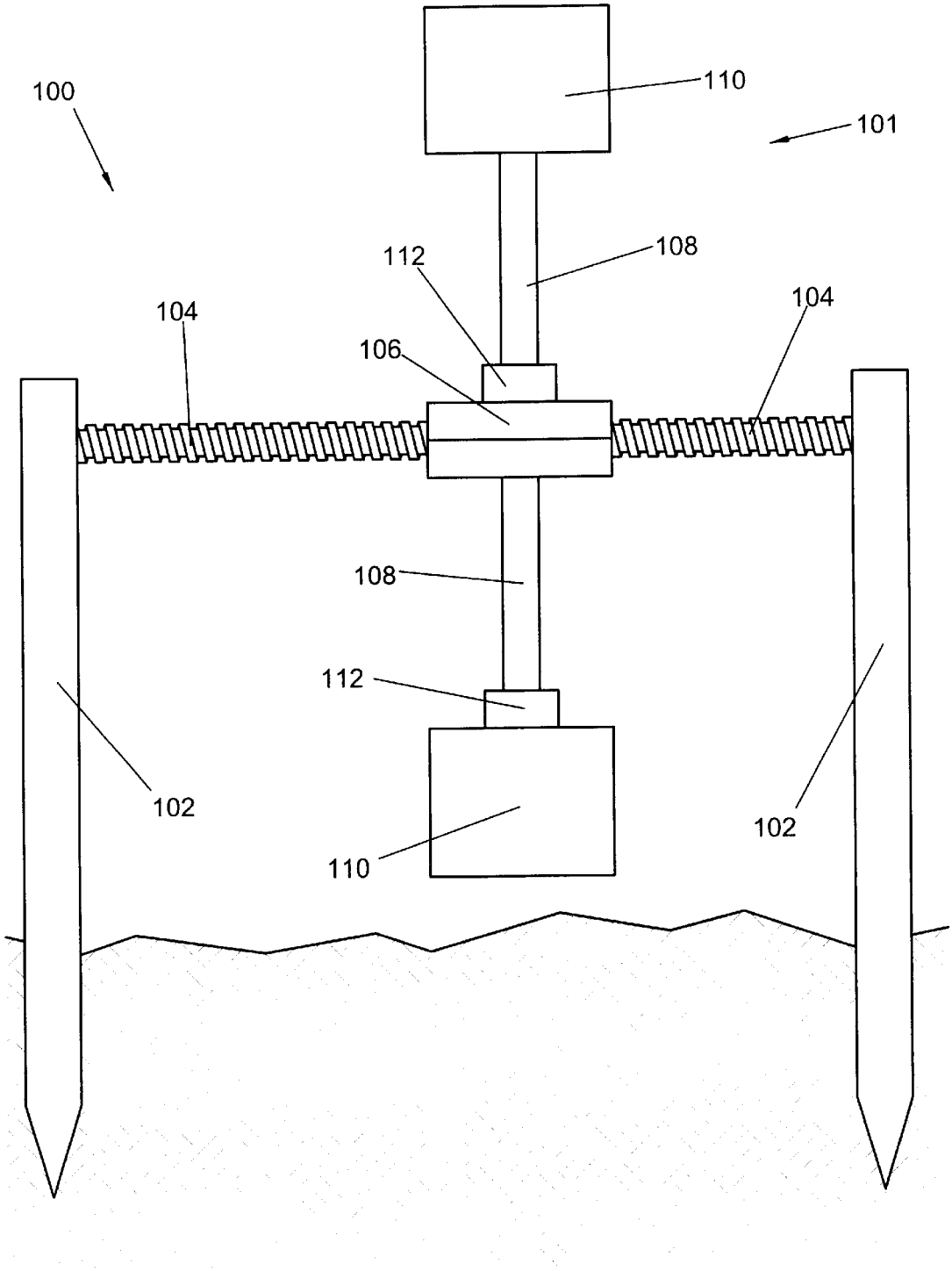
FIG. 9 is a front view of a firearms target according to the present invention.
Figure 10:
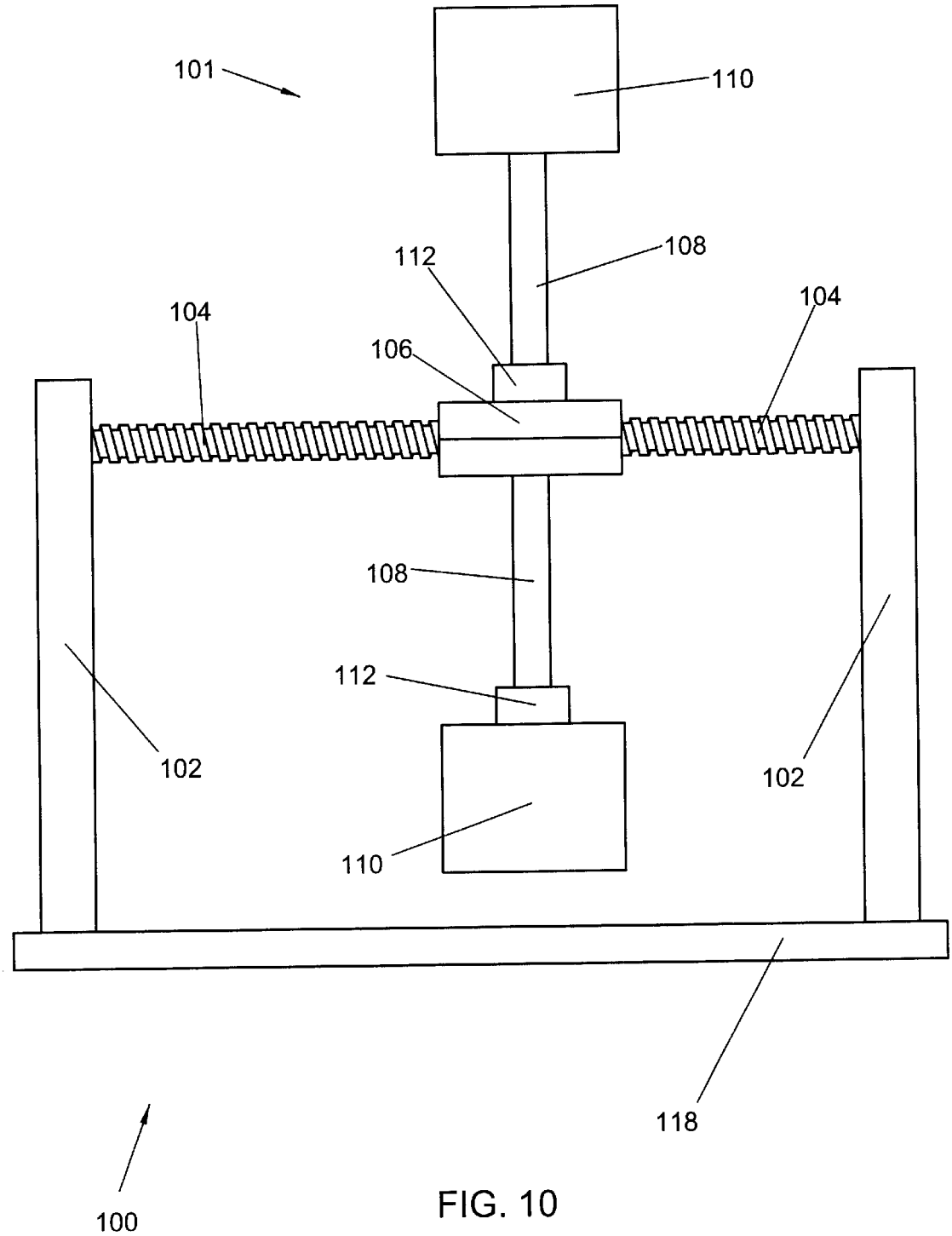
FIG. 10 is a front view of a firearms target according to the present invention.

A scale, ruling, or other device for measuring lateral movement of the spinning target may be provided for determining a winner of a shooting contest, for evaluating practice performance. A convenient location for a scale 120 may be on the rear of deflector plate 114 (FIG. 8). Other suitable locations for a scale may be used while remaining within the scope of the present invention. The lateral position of spinning target 101 along shaft 104 may be read from such a scale and provide a basis for comparative shooting performance. Such comparisons may be made between competing marksmen, between different firearms, and/or between different ammunitions. For comparing firearms performance, based on differing firearms and/or differing ammunition, the amount of lateral translation of the spinning target caused by a hit (as read from scale 120) may be used to at least qualitatively, and preferable quantitatively, compare performance. For competitive shooting games, the scale may be stylized to resemble a sports playing field or other appropriate object. A football field or racetrack may be examples of objects suitable for such representation. Target plates 110 may be similarly stylized. For example, football-shaped target plates may be used in conjunction with a scale resembling a football field. The winner of the target-shooting games is the one who first "scores a touchdown". Other thematic designs for the shooting target may be made while remaining within the scope of inventive concepts disclosed and/or claimed herein. Such designs may take the form of decals or stickers that may be applied and possibly re-applied to the target.

The shooting target may be further adapted to include position and/or velocity sensors for measuring the motion produced by projectiles impacting the target. Such sensors may include electronic, mechanical, electromechanical, or other suitable sensors. A display may be connected to these sensors for displaying the results to a marksman and/or onlookers. Digital, analog, and/or combination displays may be employed, and may include various illumination schemes. Such a display may be used in competitive and/or firearms training situations, or during testing and/or evaluation of firearms and/or ammunition.

All components of target 100 are preferably fabricated from materials able to withstand repeated impacts from bullets and/or other firearms projectiles. Heavy gauge steel may be one suitable material; any other suitably durable material may be employed while remaining within the scope of inventive concepts disclosed and/or claimed herein.

Support members 102 may take a variety of forms depending on the specific use environment for shooting target 100. Each support member may comprise a single substantially vertical leg, as shown in FIGS. 1–8. When used outdoors on unpaved ground, each support member may be driven into the ground (FIG. 7). Each may be further provided with a substantially horizontal flat plate (not shown) rigidly connected thereto for limiting the depth to which the support member is driven into the ground and for stabilizing the support member. For use on paved ground or other surface into which the support members cannot be driven, the support members may be provided with a substantially horizontal flat base plate 118 (preferably a single shared base plate, as in FIG. 8; a separate base plate for each support member may also be employed). The base plate must be sufficiently large in area and sufficiently heavy to prevent excessive movement of shooting target 100 when struck by a fired projectile. It may be desirable to permanently secure shooting target 100 to the ground or other surrounding structure (as in a shooting range, for example). Instead of single vertical support member, a triangular, truss-like structure may be employed for support member 102 (not shown). Such a truss-like structure may be driven into the ground, secured to a base plate, or permanently secured to the ground or other surrounding structure. Any other suitable structure may be employed for support members 102.

Threaded shaft 104 may be secured to support members 102 is a variety of ways. Shaft 104 may be welded to support members 102 to form a permanently assembled structure. Alternatively, shaft 104 and support members 102 may form a structure that may be repeatedly assembled and disassembled for portability, which may be particularly suitable for an embodiment having support members 102 driven into the ground. Support members 102 may be provided with threaded holes for receiving and engaging the ends of shaft 104. Such threaded holes may be integral with support member 102, or may comprise a nut or other threaded component welded or otherwise secured to support member 102. One or more lock nuts may be employed to substantially non-rotatably secure threaded shaft 104 once it is threaded into support members 102. Instead of threaded holes, support members 102 may each be provided with a clearance hole for receiving an end of shaft 102, which may be substantially non-rotatably secured to at least one of the support members 102 by a pair of nuts threaded onto shaft 104 and tightened against opposite sides of the support member. Instead of nuts, shaft 104 may be clamped within the clearance hole of at least one support member 102. Shaft 104 may be substantially non-rotatably secured to at least one support member 102 in any mechanically suitable way while remaining within the scope of inventive concepts disclosed and/or claimed herein.

The present invention has been set forth in the forms of its preferred and alternative embodiments. It is nevertheless intended that modifications to the disclosed firearms target may be made without departing from inventive concepts disclosed and/or claimed herein.

What is claimed is:

1. A shooting target, comprising:

a first support member and a second support member;

a threaded shaft supported near each end thereof by one of the support members, the threaded shaft being substantially non-rotatably secured to at least one of the support members, the threaded shaft being supported in a substantially horizontal orientation; and a spinning target positioned on, supported by, and rotatably engaged with the threaded shaft, the spinning target comprising a threaded sleeve having a threaded bore, the threaded bore receiving the threaded shaft therethrough and engaging the threaded shaft so that the threaded sleeve translates along the length of the threaded shaft as the threaded sleeve rotates, a first arm connected at a proximal end thereof to the threaded sleeve and extending away therefrom, a second arm connected at a proximal end thereof of the threaded sleeve and extending away therefrom in a direction substantially opposing a direction of the first arm, a first substantially flattened target plate connected to a distal end of the first arm, a second substantially flattened target plate connected to a distal end of the second arm, a first weight secured to the first arm and slidable along at least a portion of a length thereof, and a second weight secured to the second arm and slidable along at least a portion of a length thereof.

2. The shooting target of claim 1, the first arm, first target plate, and first weight being substantially identical in size and weight to the second arm, second target plate, and second weight, respectively.

3. The shooting target of claim 1, the threaded bore of the threaded sleeve being sufficiently over-sized relative to the threaded shaft so as to enable disengagement of the threaded sleeve from the threaded shaft and sliding of the threaded sleeve along the length of the threaded shaft.

4. The shooting target of claim 1, a lower end of each of the support members being adapted for being driven into the ground so as to secure the shooting target to the ground.

5. The shooting target of claim 1, further including a base plate secured to a lower end of each support member.

6. The shooting target of claim 1, further including a deflector bar substantially rigidly connected by at least one deflector support member to at least one of the support members, the deflector bar being positioned and adapted for substantially obstructing the threaded shaft along a shooting line-of-sight so as to substantially prevent an impact of a projectile on the threaded shaft if the projectile is fired along said line-of-sight.

7. The shooting target of claim 6, the deflector bar being of a sufficiently large vertical dimension so as to be adapted for substantially obstructing the threaded shaft simultaneously along multiple shooting lines-of-sight, thereby substantially preventing an impact of a projectile on the threaded shaft if the projectile is fired along one of said multiple lines-of-sight.

8. The shooting target of claim 6, the deflector support member being movable between multiple deflector positions, each of the multiple deflector positions corresponding to at least one of multiple shooting lines-of-sight, the deflector bar substantially preventing an impact of a projectile on the threaded shaft if the deflector bar is at one of the multiple deflector positions and if the projectile is fired along the corresponding line-of-sight.

9. The shooting target of claim 1, further including a measurement device for measuring translation of the spinning target along the threaded shaft.

10. The shooting target of claim 9, the measuring device including a ruled scale.

11. The shooting target of claim 9, the measuring device including at least one of a position sensor and a velocity sensor.

12. The shooting target of claim 1, the support members, threaded shaft, and spinning target are adapted for enabling repeated disassembly and reassembly.

13. A method for practicing firing of a firearm, including the steps of:

a) positioning a shooting target in a suitable shooting area, the shooting target comprising a first support member and a second support member, a threaded shaft supported near each end thereof by one of the support members, the threaded shaft being substantially non-rotatably secured to at least one of the support members, the threaded shaft being supported in a substantially horizontal orientation, and a spinning target positioned on, supported by, and rotatably engaged with the threaded shaft, the spinning target comprising a threaded sleeve having a threaded bore, the threaded bore receiving the threaded shaft therethrough and engaging the threaded shaft so that the threaded sleeve translates along the length of the threaded shaft as the threaded sleeve rotates, a first arm connected at a proximal end thereof to the threaded sleeve and extending away therefrom, a second arm connected at a proximal end thereof of the threaded sleeve and extending away therefrom in a direction substantially opposing a direction of the first arm, a first substantially flattened target plate connected to a distal end of the first arm, a second substantially flattened target plate connected to a distal end of the second arm, a first weight secured to the first arm and slidable along at least a portion of a length thereof, and a second weight secured to the second arm and slidable along at least a portion of a length thereof;

b) aiming a firearm at one of the target plates from a designated shooting location;

c) firing the firearm, a projectile from the firearm upon impact with the spinning target causing the spinning target to spin and translate along the threaded shaft;

d) repeating steps b) and c) until the spinning target reaches a pre-determined target end point.

14. A method for competing with firearms, including the steps of:

a) positioning a shooting target in a suitable shooting area, the shooting target comprising a first support member and a second support member, a threaded shaft supported near each end thereof by one of the support members, the threaded shaft being substantially non-rotatably secured to at least one of the support members, the threaded shaft being supported in a substantially horizontal orientation, and a spinning target positioned on, supported by, and rotatably engaged with the threaded shaft, the spinning target comprising a threaded sleeve having a threaded bore, the threaded bore receiving the threaded shaft therethrough and engaging the threaded shaft so that the threaded sleeve translates along the length of the threaded shaft as the threaded sleeve rotates, a first arm connected at a proximal end thereof to the threaded sleeve and extending away therefrom, a second arm connected at a proximal end thereof of the threaded sleeve and extending away therefrom in a direction substantially opposing a direction of the first arm, a first substantially flattened target plate connected to a distal end of the first arm, a second substantially flattened target plate connected to a distal end of the second arm, a first weight secured to the first arm and slidable along at least a portion of a length thereof, and a second weight secured to the second arm and slidable along at least a portion of a length thereof;

b) positioning the spinning target on the threaded shaft between two pre-determined target end points;

c) aiming a first firearm, by a first competitor, from a designated shooting location at the first target plate;

d) aiming a second firearm, by a second competitor, from a designated shooting location at the second target plate;

e) firing the first firearm by the first competitor, a projectile from the first firearm upon impact with the first target plate of the spinning target causing the spinning target to spin and translate in a first direction along the threaded shaft;

f) firing the firearm by the second competitor, a projectile from the second firearm upon impact with the second target plate of the spinning target causing the spinning target to spin and translate in a second direction opposite the first direction along the threaded shaft;

g) repeating steps c) through f) until the spinning target reaches one of the two pre-determined target end points;

h) declaring the first competitor a winner if the spinning target reaches a first of the two target end points while moving in the first direction; and i) declaring the second competitor the winner if the spinning target reaches a second of the two target end points while moving in the second direction.

15. A method for evaluating firing of a firearm, including the steps of:

a) positioning a shooting target in a suitable shooting area, the shooting target comprising a first support member and a second support member, a threaded shaft supported near each end thereof by one of the support members, the threaded shaft being substantially non-rotatably secured to at least one of the support members, the threaded shaft being supported in a substantially horizontal orientation, a spinning target positioned on, supported by, and rotatably engaged with the threaded shaft, the spinning target comprising a threaded sleeve having a threaded bore, the threaded bore receiving the threaded shaft therethrough and engaging the threaded shaft so that the threaded sleeve translates along the length of the threaded shaft as the threaded sleeve rotates, a first arm connected at a proximal end thereof to the threaded sleeve and extending away therefrom, a second arm connected at a proximal end thereof of the threaded sleeve and extending away therefrom in a direction substantially opposing a direction of the first arm, a first substantially flattened target plate connected to a distal end of the first arm, a second substantially flattened target plate connected to a distal end of the second arm, a first weight secured to the first arm and slidable along at least a portion of a length thereof, and a second weight secured to the second arm and slidable along at least a portion of a length thereof, and a measuring device for measuring translation of the spinning target along the threaded shaft;

b) firing the firearm at a target plate from a designated shooting area; and c) measuring, using the measuring device, a distance of translation along the threaded shaft of the spinning target in response to being struck and spun by a projectile fired from the firearm.

16. The method of claim 15, the distance of translation being used to evaluate an accuracy of aiming of the firearm during firing thereof.

17. The method of claim 15, the distance of translation being used to evaluate quality of ammunition fired from the firearm.

18. The method of claim 15, the distance of translation being used to evaluate quality of the firearm.

* * * * *